United States Patent [19]

Thun-Hohenstein

[11] 4,055,405

[45] Oct. 25, 1977

[54] ACCESSORY FOR USE WITH VACUUM CLEANERS OR VACUUM-CLEANING CONDUITS

[75] Inventor: Carl Thun-Hohenstein, Vienna, Austria

[73] Assignee: Reflex Mobelpflegemittel-Erzeugung Konrad Schischlik & Sohne, Vienna, Austria

[21] Appl. No.: 621,792

[22] Filed: Oct. 14, 1975

[30] Foreign Application Priority Data

Oct. 21, 1974 Austria ..... 8440/74
July 7, 1975 Austria ..... 5220/75

[51] Int. Cl.[2] ..... A47L 7/00

[52] U.S. Cl. ..... 55/216; 55/325; 55/332; 15/353

[58] Field of Search ..... 15/352, 353; 55/213, 55/216, 255, 256, 319, 325, 332, 465

[56] References Cited

U.S. PATENT DOCUMENTS

| | | | |
|---|---|---|---|
| 3,029,463 | 4/1962 | Bishop | 15/353 |
| 3,267,511 | 8/1966 | Meyerhoefer | 55/216 X |
| 3,290,865 | 12/1966 | Serou et al. | 15/353 X |

FOREIGN PATENT DOCUMENTS

| | | | |
|---|---|---|---|
| 495,509 | 6/1954 | Italy | 15/353 |

*Primary Examiner*—Christopher K. Moore

[57] ABSTRACT

An accessory for use in a vacuum cleaner or a vacuum-cleaning conduit for collecting and holding liquid sucked up by the vacuum cleaner, comprising: a container having a reservoir for holding the liquid, a removable cover for said container and extending substantially horizontally thereover, means for dividing said container into said reservoir and a chamber above said reservoir and having a substantially horizontally extending plate, an inlet fitting connected to said cover for connecting the interior of sand reservoir to a hose leading to the suction nozzle of the vacuum cleaner or a vacuum cleaning conduit, said inlet fitting including a pipe extending vertically and having a lower end portion extending into said reservoir, an outlet fitting in said cover for connection to a hose leading to the body of the vacuum cleaner or vacuum-cleaning conduit and communicating with said chamber, at least one passage in said plate between said chamber and said reservoir, and a float-controlled valve including a float vertically guided on said lower end portion and a sealing plate loosely arranged on said float and adapted to close said passage to thereby shut off said chamber from said reservoir when the liquid in said reservoir reaches a predetermined level.

7 Claims, 2 Drawing Figures

ACCESSORY FOR USE WITH VACUUM CLEANERS OR VACUUM-CLEANING CONDUITS

Figure 1:
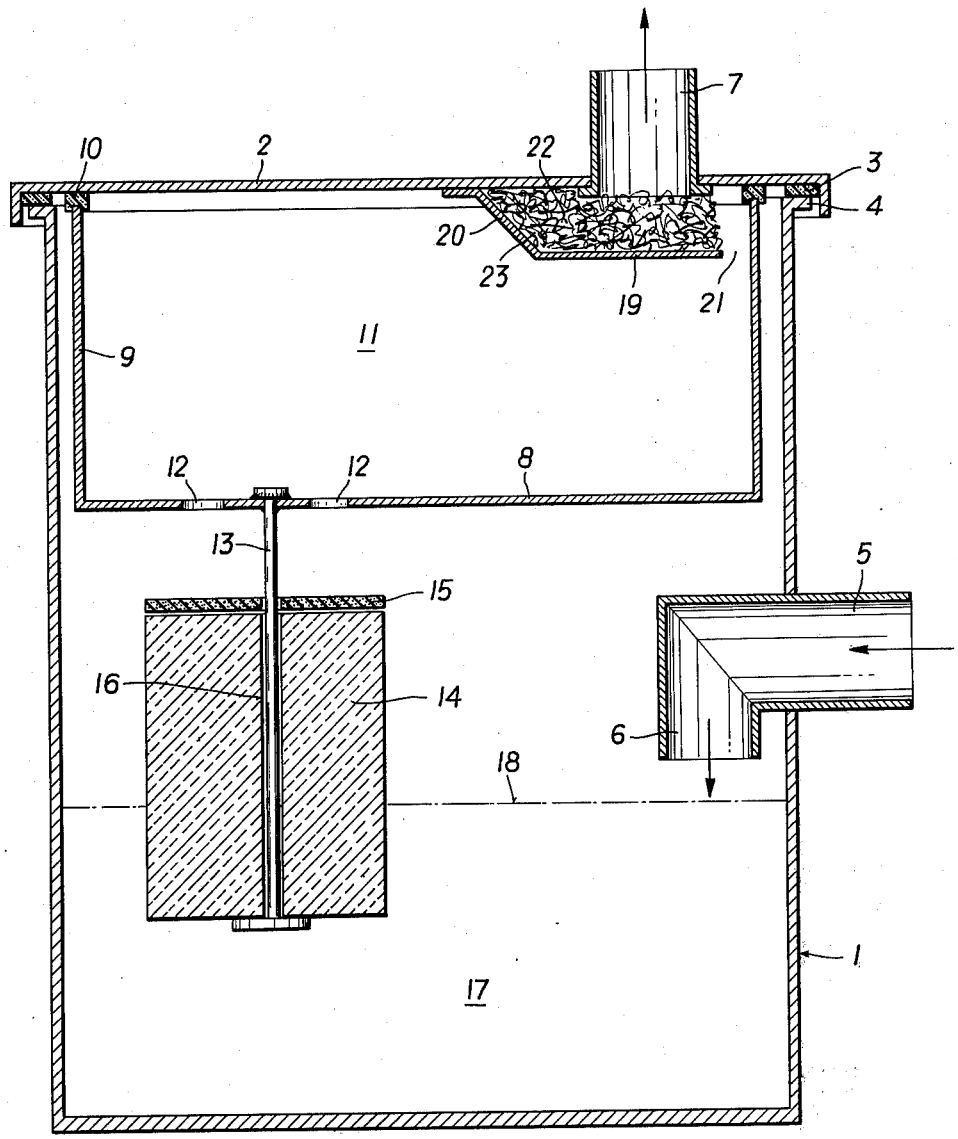

This invention relates to an accessory which may be used with vacuum cleaners or vacuum-cleaning conduits to permit of a sucking of liquid, particularly a sucking of soiled liquid and possibly washing fluid from wall-to-wall carpets which have been washed. The accessory may also permit of a sucking of liquids from smooth floors which have been washed. Known accessories of this kind are firmly connected to the suction nozzle and accomodated in an enlarged portion of the conventional tube which serves as a handle rod for the suction nozzle. Such accessory is provided at its lower end with an inlet fitting connected to the suctio nozzle and at its upper end with an outlet fitting connected to the body of the vacuum cleaner. This tube serving as a handle rod is not stationary but is held by hand in an inclined position when the vacuum cleaner is being used. The liquid which has been sucked collects in a collecting compartment of the attachment. When the handle rod provided with the attachment is laid down, liquid may flow to the upper outlet fitting and from the latter into the body of the vacuum cleaner. Moisture is deleterious for the vacuum cleaner and involves a risk of electric short circuits. For this reason the known accessories of this kind must be provided with a complicated valve system to prevent the liquid contained in the attachment from reaching the upper outlet fitting. Another disadvantage of these accessories provided on the handle rod of the suction nozzle resides in that they can hold only a relatively small volume of sucked liquid.

This invention relates to an accessory for use with vacuum cleaners or vacuum-claening conduits, which accessory serves to collect and hold liquids which have been sucked and comprises an inlet fitting for connection to a hose leading to the suction nozzle, an outlet fitting for connection to a hose leading to the body of the vacuum cleaner or to the vacuum-cleaning conduit, a reservoir which is connected to the inlet fitting and serves to collect the liquid which has been sucked, and a float-controlled valve between the reservoir and the outlet fitting, and resides essentially in that the accessory comprises a container, which is adapted to be placed on the floor and contains the reservoir and is provided with the inlet fittng and the outlet fitting. Because the accessory comprises a container which can be placed on the floor, the accessory has a predetermined orientation so that the valve arrangement can be much simplified. Besides, the accessory according to the invention can be designed to hold any desired volume of collected liquid.

According to the invention the inlet fitting suitably opens into a downwardly directed pipe, which is disposed in the container. This feature promotes the separation of liquid from the air-liquid mixture which enters the reservoir. The arrangement is suitably such that the outlet fitting is provided in an approximately horizontal wall, which covers the container at its top. In this way, the outlet fitting connected to the body of the vacuum cleaner is provided at the uppermost point of the container so that water cannot enter the vacuum cleaner or the hose connected thereto from a unit which is placed on the floor. For this reason it will be sufficient if a valve provided to shut off the liquid reservoir from the outlet fitting responds when the liquid in the reservoir exceeds a predetermined level. Such valve may be simpler than a valve which must ensure a shut-off when the accessory is in various positions. According to the invention, the float may be approximately vertically guide and may be provided at its top with a sealing plate, e.g., of rubber, for shutting off the reservoir from the outlet fitting.

According to the invention, the container is suitably divided by an approximately horizontal plate, which has at least one passage opening. Air is sucked through this passage opening or openings from the outlet fitting. This partition obstructs a flow of liquid to the outlet fitting because only the passage openings provide a path for the liquid. In a preferred embodiment, the arrangement is such that the approximately horizontal plate by which the container is divided constitutes the bottom of a pot, which tightly adjoins the wall that covers the container at its top, the sealing plate of the float is adapted to close the passage openings in the plate, and the pot and the wall which covers the container at its top confine a closed vacuum chamber, which communicates with the outlet fitting. In this way, a chamber is provided, which is aadjacent to the outlet fitting and which is kept free of liquid by the float valve so that the risk of a sucking of liquid into the vacuum cleaner hose is further reduced. This will be of special significance if from is sucked together with the liquid. Such foam has a low specific gravity so that the float is raised to its shut-off position at a later time. To prevent foam particles which may enter this enclosed vacuum chamber from being sucked into the outlet fitting, the latter is suitably shielded by a baffle plate disposed under the outlet fitting. It will also be desirable to provide a filter, e.g. of porous foam, in the air path which leads from the openings which are adapted to be closed by the sealing plate of the float to the outlet fitting so that an ingress of liquid particles into the outlet fitting is further opposed. According to the invention this filter is desirably disposed between the baffle plate and the outlet fitting. According to the invention it is also desirable to provide the float with a sealing plate which loosely lies on the float. The sealing plate is lighter than the float and if the sealing plate lies loosely on the float the sealing plate will already be sucked by the vacuum when the float has moved the sealing plate close to the opening which is to be closed. Particularly when foam enters the space between the sealing plate and the seat portion which is engageable by the sealing plate and formed with the openings which are to be closed, the flow of air will be throttled so that the suction action on the sealing plate is increased and the sealing plate effects a seal at an earlier time.

The arrangement is preferably such that the float and the sealing plate have a central bore, which receives a guide rod, and the openings adapted to be closed by the sealing plate are arranged around the guide rod.

According to the invention the wall which covers the container at its top and which is provided with the outlet fitting suitably consists of a removable cover, which rests on the top rim of the container, with a gasket interposed, and which carries the internal components of the accessory. This arrangement will afford the advantage that the internal components can easily be rendered accessible in that the cover is removed. According to a preferred embodiment of the invention, the outlet fitting as well as the inlet fitting are provided on the removable cover. This enables the use of a container consisting of a conventional pail and of a cover placed on the top rim of the pail. As a result, costs will be saved and the space required to accomodate the accessory will be much reduced because such pail can be used for various purposes and is anyway required in every household. It is merely essential that the pail has a flat top rim and that the bail does not extend through openings in the wall of the pail but is connected to the outside of the pail so that the latter can be tightly sealed by the cover.

In a particularly desirable embodiment, the cover has a flat sealing surface, which cooperates with the top rim of the container. This feature affords the advantage that the cover provided with all parts of the accessory can be mounted on pails or other containers of various sizes. Whereas fixing means, such as clamps, may be provided to connect the cover to the pail or other container, such fixing means are not essential because the vacuum produced in operation ensures a tight joint between the cover and the container. It has been found that a container which holds about 10 liters of water can be raised from the floor by means of the cover during the action of the vacuum.

According to the invention, the inlet fitting comprises a vertical pipe or opens into a vertical pipe, and the lower end of said vertical pipe constitutes a guide for the float. Because the inlet fitting is mounted in the cover, the vertical pipe may be relatively long. The pipe promotes the separation of liquid from the air-liquid mixture which has been sucked. A segregation takes place even in the pipe and water droplets will all into the reservoir. This vertical pipe ensures also a satisfactory guidance of the float. The vertical pipe provided with the inlet fitting is suitably centered on the cover and the internal components of the accessory are clamped to the cover by means of this vertical pipe. This arrangement facilitates the assembling of the components to the inside of the cover.

The float is suitably disposed on such a level that its sealing plate seals the openings when the water level in the container corresponds to about one-third of the height of the container. In that case, about two-thirds of the height of the container are kept free so that even in case of a strong foaming there is no risk of an ingress of foam into the outlet fitting. Because the container is placed on the floor, it may be of sufficient size, e.g., of the size of a conventional pail, so that one-third of the container is sufficient for a reservoir for the sucked liquid during normal operation. Because the cover is removable, the liquid collected in the container may easily be dumped.

An illustrative embodiment of the invention is diagrammatically shown on the drawing.

Figure 2:
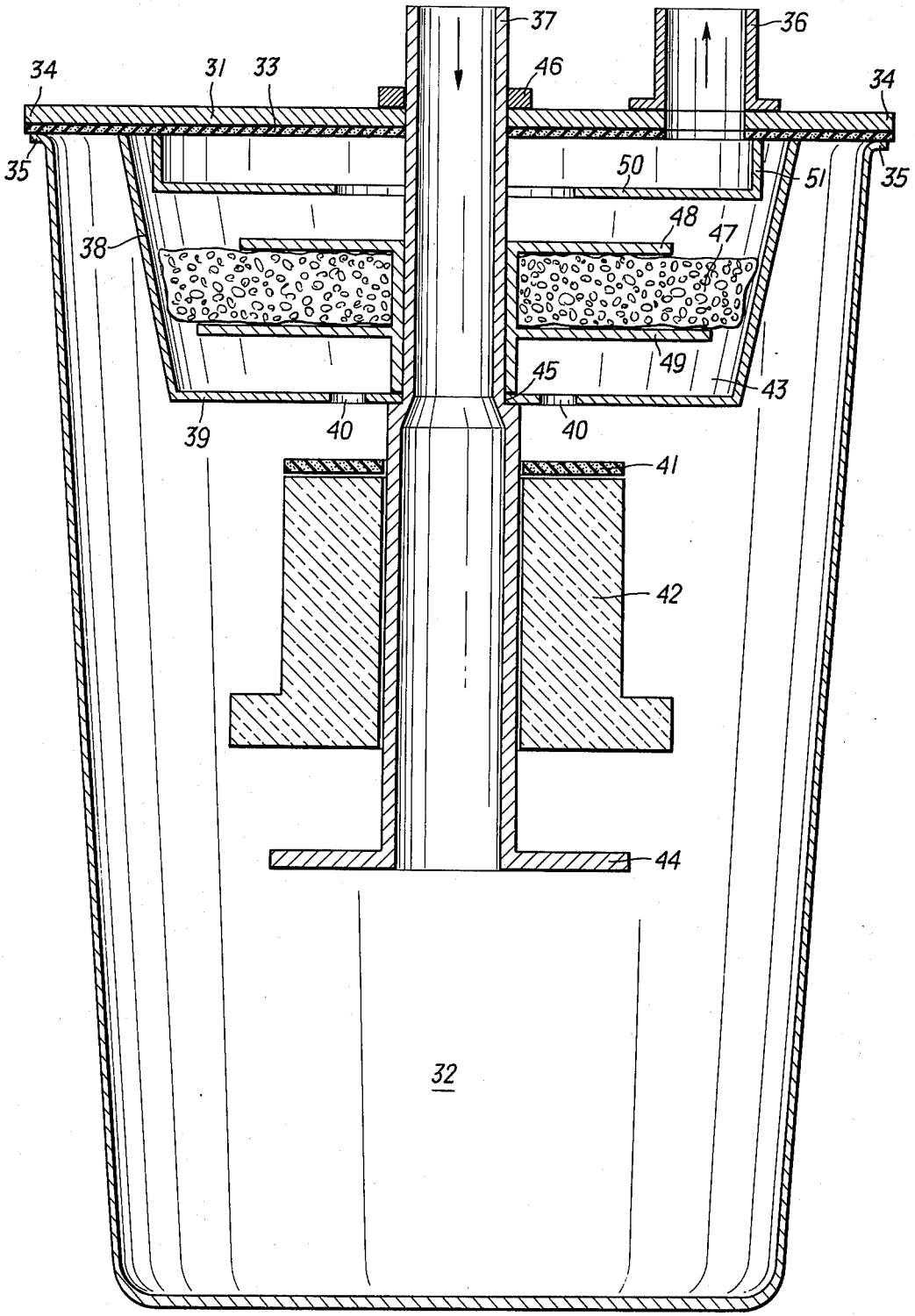

FIGS. 1 and 2 are vertical sectional views showing two embodiments of the accessory according to the invention.

FIG. 1 shows a container 1, which is adapted to be placed on the floor and closed by a removable cover 2, which rests on the top rim 4 of the container with a gasket 3 interposed. The side wall of the container 1 is provided with an inlet fitting 5, on which a hose is fitted which is connected to the suction nozzle. The inlet fitting opens into a vertical pipe 6. The cover 2 is provided with an outlet fitting 7, to which a hose is fitted which is connected to the body of the vacuum cleaner. A horizontal plate 8 is provided, which constitutes the bottom of a pot, which has a cylindrical wall 9 extending from the plate 8. The pot is tightly joined to the cover 2 with a gasket 10 interposed and confines a closed vacuum chamber.

The plate 8 has openings 12. A rod 13 constitutes a vertical guide for a float 14, which consists, e.g., of polystyrene foam. A sealing plate 15, e.g. of rubber, lies loosely on the float. The sealing plate 15 and the float 14 have a bore 16, through which the rod 13 extends. A dash-dot line 18 indicates the highest water level in the reservoir 17, which is enclosed by the container 1. When this highest water level 18 has been reached, the float 14 is raised so that the sealing plate 15 seals the openings 12.

The outlet fitting 7 is shielded by a plate 19. The space between this plate 19 and the cover 2 is closed by an inclined wall 20 so that only a constricted opening 21 is left for the passage of air. The space 22 between the plate 19 and the outlet fitting is filled with a filter material 23, e.g. porous plastics material.

The embodiment shown in FIG. 2 comprises a cover 31, which is placed on the container 32, which consists, e.g., of a conventional pail. To ensure a tight fit, the underside of the cover is lined with a plate 33 of sealing material. The plate 33 is flat and the cover 31 has a protruding rim 34 so that the cover can be placed on pails of various sizes, provided that the top rim 35 of the pail is flat. The cover is provided with the outlet fitting 36 and the inlet fitting 37. The hose connected to the body of the vacuum cleaner is fitted on the outlet fitting 36. The hose connected to the suction nozzle is fitted on the inlet fitting 37.

A pot 38 is in sealing engagement with the sealing plate 33 of the cover 31. The bottom 39 of the pot 38 has passage openings 40, which will be closed by a sealing plate 41 consisting, e.g., of rubber, when the same has been raised by a float 42 to a position adjacent to the openings 40. Because the sealing plate 41 lies loosely on the float 42, the vacuum applied to the vacuum chamber 43 which is confined by the pot 38 will suck the sealing plate 41 to its sealing position even when there is still a small gap between the bottom 39 and the the sealing plate 41.

The inlet fitting 37 consists of a pipe, which extends through the bottom 39 of the pot 38 and on which the float 42 and the sealing plate 41 are vertically guided. The lowermost position of the float 42 is defined by a flange 44 of the pipe 37. A shoulder 45 of the pipe 37 engages the bottom 39 of the pot 38. A nut 46 is screwed onto the pipe 37 and serves to clamp all parts together.

A filter 47 consisting, e.g., of open-cell foam is held between two annular plates 48, 49. The outlet fitting 36 is shielded by an annular plate 50, which has a turned-up rim 51, which adjoins the sealing plate 33 of the cover. The filter 47 and the annular plate 50 ensure that even liquid or foam particles which have entered the vacuum chamber 43 cannot enter the outlet fitting 36.

The embodiments of the invention in which an exclusive property or privilege is claimed are defined as follows:

1. An accessory for use in a vacuum cleaner or a vacuum-cleaning conduit for collecting and holding liquid sucked up by the vacuum cleaner, comprising: a container having a reservoir for holding the liquid, a removable cover for said container and extending substantially horizontally thereover, means for dividing said container into said reservoir and a chamber above said reservoir and having a substantially horizontally extending plate, an inlet fitting connected to said cover for connecting the exterior of said reservoir to a hose leading to the suction nozzle of the vacuum cleaner or a vacuum cleaning conduit, said inlet fitting including a pipe extending vertically and having a lower end portion extending into said reservoir, an outlet fitting in said cover for connection to a hose leading to the body of the vacuum cleaner or vacuum-cleaning conduit and communicating with said chamber, at least one passage in said plate between said chamber and said reservoir, and a float-controlled valve including a float vertically guided on said lower end portion and a sealing plate loosely arranged on said float and adapted to close said passage to thereby shut off said chamber from said reservoir when the liquid in said reservor reaches a predetermined level.

2. An accessory according to claim 1, wherein said vertical pipe is centered on said cover and said pipe includes means for clamping said dividing means to said cover.

3. An accessory according to claim 2, wherein said means on said vertical pipe is a shoulder.

4. An accessory according to claim 1, comprising a filter between said passage and said outlet fitting.

5. An accessory according to claim 1, comprising a baffle plate shielding and being disposed under the outlet fitting within said chamber.

6. An accessory according to claim 1, wherein said float is disposed on such a level that said sealing plate seals said passage when the liquid level in said container corresponds to about one third of the height of the container.

7. An accessory according to claim 1, wherein said float is guided externally along said lower end portion of said vertical pipe and wherein said sealing plate is an annular plate.

* * * * *

UNITED STATES PATENT AND TRADEMARK OFFICE

CERTIFICATE OF CORRECTION

PATENT NO. : 4,055,405

DATED : October 25, 1977

INVENTOR(S) : CARL THUN-HOHENSTEIN

It is certified that error appears in the above-identified patent and that said Letters Patent are hereby corrected as shown below:

Column 4, line 68, change "exterior" to -- interior --.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*